US009551335B2

(12) United States Patent
Prins

(10) Patent No.: US 9,551,335 B2
(45) Date of Patent: Jan. 24, 2017

(54) METHOD OF COORDINATING OPERATION OF COMPRESSORS

(71) Applicant: Danfoss A/S, Nordborg (DK)

(72) Inventor: Jan Prins, Nordborg (DK)

(73) Assignee: Danfoss A/S, Nordborg (DK)

( * ) Notice: Subject to any disclaimer, the term of this patent is extended or adjusted under 35 U.S.C. 154(b) by 384 days.

(21) Appl. No.: 14/349,765

(22) PCT Filed: Oct. 5, 2012

(86) PCT No.: PCT/DK2012/000110

§ 371 (c)(1),
(2) Date: Apr. 4, 2014

(87) PCT Pub. No.: WO2013/050036

PCT Pub. Date: Apr. 11, 2013

(65) Prior Publication Data

US 2014/0271259 A1 Sep. 18, 2014

(30) Foreign Application Priority Data

| | | |
|---|---|---|
| Oct. 7, 2011 | (DK) | 2011 00780 |
| Nov. 18, 2011 | (DK) | 2011 00906 |
| Feb. 2, 2012 | (EP) | 12 000708 |

(51) Int. Cl.
*F04B 41/06* (2006.01)
*F25B 1/10* (2006.01)
(Continued)

(52) U.S. Cl.
CPC ..... *F04B 41/06* (2013.01); *F25B 1/10* (2013.01); *F25B 7/00* (2013.01); *F25B 49/022* (2013.01)

(58) Field of Classification Search
CPC ..... F25B 1/10; F25B 7/00; F25B 49/022; F25B 1/00; F25B 49/025; F25B 49/02; F04B 41/06
(Continued)

(56) References Cited

U.S. PATENT DOCUMENTS

| | | | |
|---|---|---|---|
| 3,580,006 | A | 5/1971 | Quick |
| 4,384,462 | A | 5/1983 | Overman et al. |

(Continued)

FOREIGN PATENT DOCUMENTS

| | | | |
|---|---|---|---|
| CA | 2312175 | A1 | 12/2001 |
| EP | 1 790 919 | A1 | 5/2007 |

OTHER PUBLICATIONS

International Search Report for PCT Serial No. PCT/DK2012/000110 dated Jan. 29, 2013.

(Continued)

*Primary Examiner* — Mohammad M Ali
(74) *Attorney, Agent, or Firm* — McCormick, Paulding & Huber LLP

(57) ABSTRACT

A method for coordinating operation between at least two groups of compressors in a cooling circuit is disclosed. A first group of compressors forms part of a low temperature (LT) part of the cooling circuit and a second group of compressors forms part of a high temperature (MT) part of the cooling circuit. Each of the compressor groups comprises one or more compressors, and each of the compressor groups comprises a controller, the controllers being capable of exchanging signals. In the case that the LT compressor group needs one or more of the LT compressors to start operation, it is investigated whether or not one or more of the MT compressors is/are operating. If this is the case, one or more of the LT compressors is/are allowed to start operation. If it is not the case, the suction pressure in the MT part of the (Continued)

cooling circuit is established, e.g. measured, and compared to a lower and an upper limit of a neutral pressure zone, said neutral pressure zone lying within an operating pressure zone of the MT part of the cooling circuit. Finally, the MT compressors and the LT compressors are operated based on the comparing step. The cooling system may be a cascade system or a booster system.

18 Claims, 2 Drawing Sheets

(51) Int. Cl.
*F25B 7/00* (2006.01)
*F25B 49/02* (2006.01)

(58) Field of Classification Search
USPC ..... 417/53, 62
See application file for complete search history.

(56) References Cited

U.S. PATENT DOCUMENTS 6,161,391 A * 12/2000 Trieskey ..... F25B 5/02 62/335
6,405,554 B1 * 6/2002 Kawakatu ..... F25B 7/00 62/175
7,908,875 B2 * 3/2011 Smith ..... F25B 49/005 62/129
8,950,204 B2 * 2/2015 Woo ..... F24D 3/18 62/160
2002/0148239 A1 * 10/2002 Trieskey ..... F25B 5/02 62/79
2004/0118139 A1 * 6/2004 Kelly ..... F25B 7/00 62/199
2004/0118145 A1 * 6/2004 Takasugi ..... F25B 7/00 62/335
2005/0106037 A1 5/2005 Kim et al.
2005/0120737 A1 * 6/2005 Borror ..... F25B 23/006 62/434
2005/0253107 A1 * 11/2005 Flynn ..... C09K 5/041 252/67
2007/0107451 A1 5/2007 Sakurai et al.
2009/0133436 A1 * 5/2009 Boiarski ..... F25B 7/00 62/513
2010/0043475 A1 * 2/2010 Taras ..... F25B 1/10 62/331
2010/0186433 A1 7/2010 Galante et al.
2010/0326109 A1 * 12/2010 Tobe ..... F25B 7/00 62/228.1
2011/0072837 A1 * 3/2011 Brown ..... F25B 7/00 62/115

OTHER PUBLICATIONS

European Search Report Serial No. EP12000708 dated Jul. 19, 2012.
Danish Search Report Serial No. PA201100906 dated Jul. 2, 2012.

* cited by examiner

METHOD OF COORDINATING OPERATION OF COMPRESSORS

CROSS REFERENCE TO RELATED APPLICATIONS

This application is entitled to the benefit of and incorporates by reference subject matter disclosed in International Patent Application No. PCT/DK2012/000110 filed on Oct. 5, 2012; Danish Patent Application No. PA 2011 00780 filed Oct. 7, 2011; Danish Patent Application No. PA 2011 00906 filed Nov. 18, 2011; and European Patent Application EP 12 000708.3 filed Feb. 2, 2012.

FIELD OF THE INVENTION

The invention relates to a method of coordinating at least two groups of compressors, a low temperature (LT) compressor group and a high temperature (MT) compressor group. The invention also relates to a system with at least two such groups of compressors and being controlled by the method according to the invention. The invention also relates to a control unit operating according to the method of the invention, and to a system with such a control unit.

BACKGROUND

In compressor cascade plants or systems, or in compressor booster plants or systems, both with multiple groups of compressors, it is necessary to perform coordination between the different groups of compressors, said different groups of compressors comprising at least one low temperature (LT) compressor and at least one high temperature (MT) compressor. Coordination is necessary when the LT compressor group needs to reject heat, but the MT compressor group is not in operation, i.e., none of the MT compressors are running. If the MT compressors are not running, the LT compressor group cannot reject heat. The LT compressor circuit is operating at lower evaporator temperatures than the evaporator temperatures of the MT compressor circuit.

EP 1 790 919 discloses an aspect directed to a refrigeration system for vapor compression refrigeration cycle including a heat source circuit provided with a high temperature compressor and a utilization circuit connected to the heat source circuit and provided with an evaporator and a low temperature compressor. The refrigeration system includes an operation control means for switching the high temperature compressor between actuated state and suspended state based on a refrigerant suction pressure; and an actuation control means for actuating the low temperature compressor to increase the refrigerant suction pressure in the high temperature compressor when the high temperature compressor is suspended and given conditions including a condition concerning a request for cooling in the evaporator are met. The high temperature compressor is switched between actuated state and suspended state based on the refrigerant suction pressure. In the process of restarting the high temperature compressor in the suspended state, if given conditions including a condition concerning a request for cooling in the evaporator are met, the low temperature compressor is actuated to increase the refrigerant suction pressure in the high temperature compressor.

The high temperature compressor and the low temperature compressor of EP 1 790 919 are connected serially in a one part circuit only, and are not connected in parallel. There is no cooling circuit divided into a low temperature (LT) part of the cooling circuit and having one or more compressors exclusive to the low temperature part, and a high temperature (MT) part of the cooling circuit and having one or more other compressors exclusive to the high temperature part.

SUMMARY

The present invention operates so that the MT compressor group constitutes the master functionality of the cooling plant, and the LT compressor group constitutes the slave functionality of the cooling plant.

The invention is especially applicable in supermarket cooling plants, and even more applicable if the cooling medium is carbon dioxide ($CO_2$). However, other applications and other cooling mediums are possible as well.

The problem to be solved is that—under some conditions—starting of one or more LT compressors may result in undesirable high suction pressure of the MT compressors while—under some (other) conditions—starting of one or more MT compressors may result in undesirable low suction pressure of the MT compressors. Too low or too high a suction pressure in the MT compressor circuit is undesirable for various reasons, e.g., it may violate allowed operation limits of either or both of the MT compressor group itself or of both the MT compressor group and the LT compressor group.

Apart from that, it may be necessary to provide a signal to a possible injection regulator of the compressor plant, so that any injection of refrigerant into the MT compressor group circuit is started and is stopped in a synchronous manner in relation to start and stop of one or more of the MT compressors. Injection of refrigerant into a cascade heat exchanger on the MT compressor circuit side may be necessary for having sufficient refrigerant in the MT compressor circuit side of the cascade heat exchanger for the LT compressor group to be able to reject heat generated during prolonged operation of the LT compressor group and/or to be able to reject heat generated at a point of time where the MT compressor group is not in operation or has just started operation.

An object of the invention is to coordinate at least two compressor groups, a low temperature (LT) compressor group and a high temperature (MT) compressor group, in a cascade compressor cooling system or in a booster compressor cooling system, so that the LT compressors are allowed to start operation only when risk of faulty operation of the MT compressor group or risk of alarm being triggered in the MT compressor group or other malfunctions of the MT compressor group are avoided due to allowing operation of the LT compressors.

According to a first aspect the invention provides a method for coordinating operation between at least two groups of compressors in a cooling circuit, a first group of compressors forming part of a low temperature (LT) part of the cooling circuit and a second group of compressors forming part of a high temperature (MT) part of the cooling circuit, each of the compressor groups comprising one or more compressors, and each of the compressor groups comprising a controller, the controllers being capable of exchanging signals, the method comprising the following steps:

- the LT compressor group needing one or more of the LT compressors to start operation,
- investigating whether or not one or more of the MT compressors is/are operating,
- in the case that one or more of the MT compressors is operating, allowing one or more of the LT compressors to start operation, in the case that none of the MT compressors is operating:

establishing the suction pressure in the MT part of the cooling circuit, and comparing the suction pressure to a lower and an upper limit of a neutral pressure zone, said neutral pressure zone lying within an operating pressure zone of the MT part of the cooling circuit, and operating the MT compressors and the LT compressors based on the comparing step.

The first aspect of the invention relates to a method for coordinating operation between at least two groups of compressors in a cooling circuit. In the present context the term 'cooling circuit' should be interpreted to mean a system in which refrigerant is alternatingly compressed and expanded, while flowing along a closed refrigerant path. Suitable heat exchangers, e.g. in the form of evaporators, condensers and/or gas coolers, are arranged in the refrigerant path, thereby allowing heat exchange between refrigerant flowing in the refrigerant path and a secondary fluid flow. Thereby the system is capable of providing cooling or heating for a closed volume arranged around one of the heat exchangers. The cooling circuit may, e.g., be or form part of a cooling system of a supermarket. Such cooling systems normally include several separate cooling compartments, which may not all be operated at the same setpoint temperature. For instance, some of the cooling compartments may be arranged for providing cooling (typically operated at a setpoint temperature around 5° C.), while other cooling compartments may be arranged for providing freezing (typically operated at a setpoint temperature around −18° C.).

A first group of compressors form a part of a low temperature (LT) part of the cooling circuit, and a second group of compressors form a part of a high temperature (MT) part of the cooling circuit. The LT part of the cooling circuit could advantageously be a part of the cooling circuit which controls the temperature inside one or more freezing compartments of a cooling system, while the MT part of the cooling circuit could be a part of the cooling circuit which controls the temperature inside one or more cooling compartments of the cooling system.

For instance, the evaporator temperature of the low temperature (LT) part of the cooling system may be between −50° C. and −10° C., such as between −40° C. and −20° C., such as approximately −30° C. Similarly, the evaporator temperature of the high temperature (MT) part of the cooling system may be between −20° C. and 10° C., such as between −10° C. and 5° C., such as approximately −5° C.

Each compressor group comprises a controller arranged to control operation of a respective group of compressors. The controllers are further capable of exchanging signals. Thereby it is possible to operate the groups of compressors in dependence of each other.

The MT compressor group may advantageously be controlled in such a manner that the suction pressure in the MT part of the cooling circuit is kept within a specific operating pressure zone. It is also advantageous to control the LT compressor group in such a manner that the suction pressure in the LT part of the cooling circuit is kept within an operating pressure zone. However, since the MT part and the LT part both form part of the same cooling system, operation of the LT compressors affects the suction pressure in the MT part of the cooling circuit, and vice versa. Accordingly, if one or more of the LT compressors is/are started while none of the MT compressors are running, there is a risk that the operation of the LT compressor(s) drives the suction pressure in the MT part of the cooling circuit outside the operating pressure zone.

According to the invention, when the LT compressor group needs one or more of the LT compressors to start operation, it is initially investigated whether or not one or more of the MT compressors is/are operating. If this is the case, the LT compressor group is simply allowed to start operation of the required LT compressor(s), since in this case the operating MT compressor(s) will be able to counteract any detrimental effects of the operation of the LT compressor (s) on the suction pressure of the MT part of the cooling circuit.

In the case that none of the MT compressors is operating, the suction pressure in the MT part of the cooling circuit is established. This may, e.g., be done by measuring the suction pressure by means of a pressure probe arranged in the suction line of the MT part of the cooling circuit. As an alternative, the suction pressure may be derived or calculated from one or more other measured parameters.

The established suction pressure is then compared to a lower and an upper limit of a neutral pressure zone. The neutral pressure zone lies within the operating pressure zone of the MT part of the cooling circuit, i.e. the lower limit of the neutral pressure zone is higher than the lower limit of the operating pressure zone, and the upper limit of the neutral pressure zone is lower than the upper limit of the operating pressure zone. Furthermore, the neutral pressure zone may advantageously contain a setpoint pressure value being an optimal suction pressure of the MT part of the cooling circuit. Accordingly, the neutral pressure zone represents a pressure range in which it is particularly advantageous for the suction pressure of the MT part of the cooling circuit.

Finally, the MT compressors and the LT compressors are operated based on the comparing step. Accordingly, the MT compressors and the LT compressors are operated based on whether the suction pressure in the MT part of the cooling circuit is within the neutral pressure zone, above the neutral pressure zone or below the neutral pressure zone. Thereby it is possible to foresee expected detrimental effects on the suction pressure in the MT part of the cooling circuit, caused by starting operation of one or more LT compressors, or by starting one or more MT compressors, and it is possible to counteract such detrimental effects in order to ensure that the suction pressure remains within the operating pressure zone.

The step of operating the MT compressors and the LT compressors may comprise the steps of:

in the case that the suction pressure in the MT part of the cooling circuit is within the neutral pressure zone, starting at least one MT compressor and at least one LT compressor substantially simultaneously, in the case that the suction pressure in the MT part of the cooling circuit is below the lower limit of the neutral pressure zone, starting at least one of the LT compressors, while preventing the MT compressors from starting, and in the case that the suction pressure in the MT part of the cooling circuit is above the upper limit of the neutral pressure zone, starting at least one of the MT compressors, while preventing the LT compressors from starting.

If the suction pressure in the MT part of the cooling circuit is within the neutral pressure zone, the suction pressure is close to an optimum suction pressure value, and it is therefore desired to keep suction pressure substantially constant. Therefore, in order to counteract the effects which starting operation of one or more of the LT compressors will have on the suction pressure in the MT part of the cooling circuit, one or more MT compressors is/are started simultaneously with starting the one or more LT compressors.

If the suction pressure in the MT part of the cooling circuit is below the lower limit of the neutral pressure zone, the suction pressure is between the lower limit of the operating pressure zone and the neutral zone. In this case there is a risk that the suction pressure drops below the lower limit of the operating pressure zone if the one or more MT compressors is/are started. On the other hand, starting one or more of the LT compressors will increase the suction pressure in the MT part of the cooling circuit, thereby driving the suction pressure closer to the desired neutral pressure zone. Therefore, in this case one or more of the LT compressors is/are allowed to start, but start of the MT compressors is prevented.

If the suction pressure in the MT part of the cooling circuit is above the upper limit of the neutral pressure zone, the suction pressure is between the neutral zone and the upper limit of the operating pressure zone. In this case there is a risk that the suction pressure increases above the upper limit of the operating pressure zone if one or more LT compressors is/are started. On the other hand, starting one or more of the MT controllers will decrease the suction pressure in the MT part of the cooling circuit, thereby driving the suction pressure closer to the desired neutral pressure zone. Therefore, in this case one or more of the MT compressors is/are started, but start of the LT compressors is prevented.

The step of operating the MT compressors and the LT compressors may further comprise the steps of:

monitoring the suction pressure in the MT part of the cooling circuit, and when the suction pressure of the MT part of the cooling circuit reaches the neutral pressure zone, starting at least one of the MT compressors in the case that at least one of the LT compressors was/were previously started, or starting at least one of the LT compressors in the case that at least one of the MT compressors was/were previously started.

According to this embodiment, in the case that it was initially established that the suction pressure in the MT part of the cooling circuit was below the lower limit of the neutral pressure zone, resulting in operation of one or more LT compressors being started, it is awaited that the suction pressure is increased sufficiently to enter the neutral pressure zone. Once this occurs, one or more MT compressors is/are started, in order to keep the suction pressure in the MT part of the cooling circuit within the neutral zone.

Similarly, in the case that it was initially established that the suction pressure in the MT part of the cooling circuit was above the upper limit of the neutral zone, resulting in operation of one or more MT compressors being started, it is awaited that the suction pressure is decreased sufficiently to enter the neutral zone, thereby indicating that it is safe to start one or more of the LT compressors as desired. Once this occurs, one or more LT compressors is/are started, in order to control the suction pressure in the LT part of the cooling circuit to be within a desired operating pressure zone.

The step of investigating whether or not one or more of the MT compressors is/are operating may comprise the steps of the LT controller transmitting a request signal to the MT controller, and the MT controller generating and transmitting a response signal to the LT controller. According to this embodiment, the LT controller, whishing to start operation of one or more LT compressors, transmits a request signal to the MT controller in order to investigate whether or not it is safe to start one or more of the LT compressors. Since the MT controller controls operation of the MT compressors, it 'knows' whether or not one or more of the MT compressors is/are operating. If this is the case, the MT controller can generate and transmit a signal to the LT controller, allowing that one or more of the LT compressors starts operating. If none of the MT compressors is operating, the MT controller can initiate the investigation of the suction pressure in the MT part of the cooling circuit, in the manner described above, and generate and transmit a response signal based on the outcome of this investigation. Thus, the response signal generated and transmitted by the MT controller is either a 'release' signal allowing that operation of one or more of the LT compressors is/are started or a 'hold' signal preventing the LT compressors from starting. The 'hold' signal may simply be omitting sending a release signal.

The cooling system may be a cascade cooling system, in which case the method may further comprise the step of injecting refrigerant into the MT side of the cascade heat exchanger of the cooling circuit in the case that the operating step results in one or more LT compressors being started. According to this embodiment, heat exchange takes place between refrigerant flowing in the LT part of the cooling system and refrigerant flowing in the MT part of the cooling system, but the refrigerant paths of the LT part and the MT part of the cooling system are not fluidly connected. In the case that there is no liquid refrigerant present in the MT part of the cascade heat exchanger when one or more LT compressors is/are started, starting the LT compressor(s) will not lead to evaporation in the MT part of the cascade heat exchanger. Therefore the suction pressure in the MT part of the cooling circuit will not increase, and the MT controller will therefore not start the MT compressor(s). As a consequence, heat exchange does not take place in the cascade heat exchanger, and the LT part of the cascade heat exchanger can not reject heat as required. In order to avoid this situation, liquid refrigerant can be injected into the MT part of the cascade heat exchanger.

As an alternative, the cooling system may be a booster cooling system. According to this embodiment, the refrigerant paths of the LT part and the MT part of the cooling system are fluidly interconnected. For instance, refrigerant may be supplied directly from the LT compressors to the MT compressors.

According to a second aspect the invention provides a control unit for coordinating operation between at least two groups of compressors in a cooling circuit, a first group of compressors forming part of a low temperature (LT) part of the cooling circuit and a second group of compressors forming part of a high temperature (MT) part of the cooling circuit, each of the compressor groups comprising one or more compressors, the control unit comprising:

an LT controller arranged for controlling operation of the LT compressor group, and an MT controller arranged for controlling operation of the MT compressor group, said LT controller and said MT controller being capable of exchanging signals in order to coordinate operation of the compressor groups according to the method of the first aspect of the invention.

The control unit according to the second aspect of the invention is capable of operating the LT compressors and the MT compressors in accordance with the method of the first aspect of the invention. The remarks set forth above are therefore equally applicable here.

According to a third aspect the invention provides a plant comprising a cooling circuit with at least two groups of compressors, a first group of compressors forming part of a low temperature (LT) part of the cooling circuit and a second group of compressors forming part of a high temperature (MT) part of the cooling circuit, each of the compressor groups comprising one or more compressors, and each of the compressor groups comprising a controller, the controllers being capable of exchanging signals in order to coordinate operation of the compressor groups according to the method of the first aspect of the invention.

It should be noted that a person skilled in the art would readily recognise that any feature described in combination with the first aspect of the invention could also be combined with the second or third aspect of the invention, that any feature described in combination with the second aspect of the invention could also be combined with the first or third aspect of the invention, and that any feature described in combination with the third aspect of the invention could also be combined with the first or second aspect of the invention.

The LT controller and the MT controller may be embedded in a single common hardware unit, and the LT controller and the MT controller may be individual software applications embedded in the single common hardware unit. According to this embodiment, only one hardware unit is required instead of two. This lowers the manufacturing costs. Furthermore, it makes it easier to allow communication between the LT controller and the MT controller.

The plant may, e.g., be at least one of the following plants, a refrigeration plant for a supermarket vending area and/or a refrigeration plant for a supermarket storing area, a refrigeration plant for a distribution centre storing area, or a refrigeration plant for a manufacturing site storing area.

According to a specific embodiment the invention relates to a method for coordinating operation between at least two groups of compressors in a cooling circuit, a low temperature (LT) group comprising at least one low temperature compressor with a low temperature (LT) controller, and a high temperature (MT) group comprising at least one high temperature compressor with a high temperature (MT) controller, said LT controller and MT controller capable of exchanging signals, and said method comprising the following steps:

the LT compressor group needing one or more of the LT compressor to be allowed to start operation, i.e., to be allowed to start running, the LT controller transmitting a request signal to the MT controller, and the MT controller receiving said signal requesting one or more of the LT compressors to start, while the MT compressor group is not in operation, allowing one or more of the LT compressors to start, when the LT controller receives a release signal transmitted from the MT controller, said release signal being transmitted only when the MT compressors are in ready state, said ready state of the MT compressors being one of the following conditions:

a) the pressure of the MT compressor circuit being within a neutral zone, and one or more of the MT compressors are ready to start operation, b) the pressure of the MT compressor circuit initially being below a neutral zone, and one or more of the MT compressors are ready to start operation, c) the pressure of the MT compressor circuit initially being above a neutral zone, and one or more of the MT compressors are put into operation, and until the pressure of the MT compressor circuit subsequently has decreased from above the neutral zone to an upper limit of the neutral zone.

BRIEF DESCRIPTION OF THE DRAWINGS

Further advantages and features of the invention appear from the following description of a preferred embodiment on the basis of the enclosed figures, showing.

DETAILED DESCRIPTION

Coordination between the LT compressors and the MT compressors may be performed in different ways. In the following, one possible way of performing coordination is described by reference to the drawings.

Figure 1:
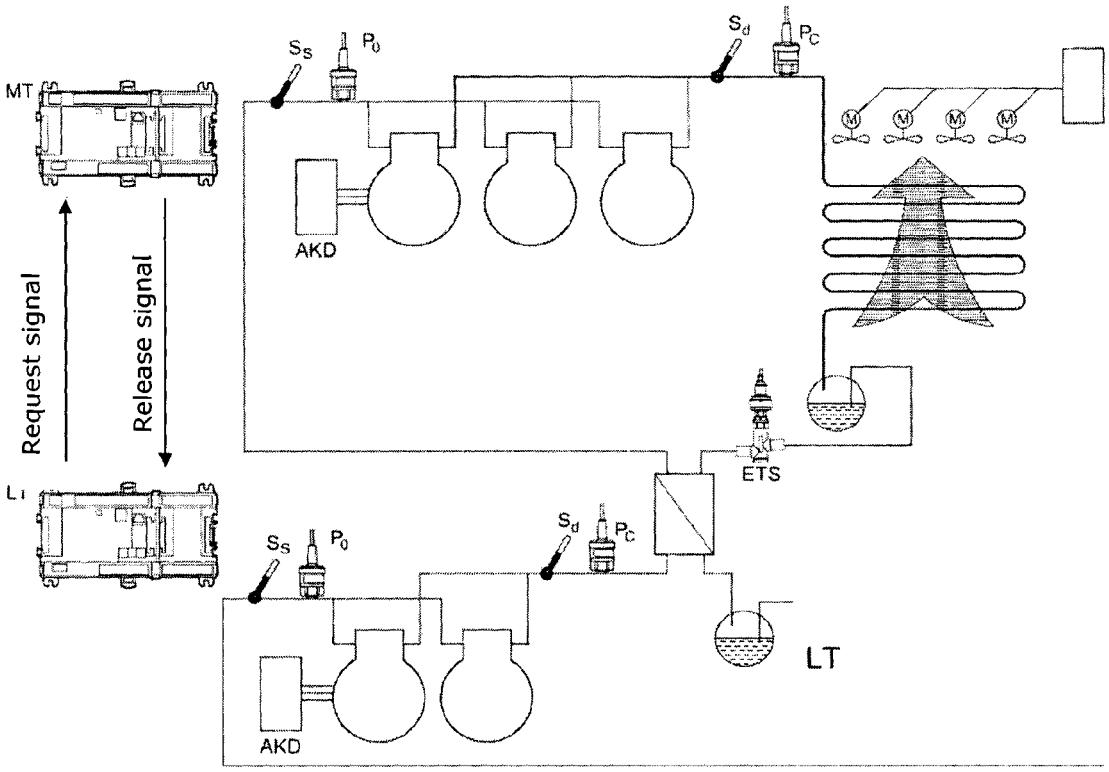
FIG. 1 is a schematic of a cooling circuit in a cooling plant with LT/MT coordination.

FIG. 1 is an example of a cooling circuit in a cooling plant with LT/MT coordination.

Part of the function of the MT controller is as follows: The MT controller utilises an input signal from the LT controller called 'Request signal', which signal is transmitted from the LT controller to the MT controller, when the LT compressor group needs to reject heat. The MT controller also utilises an output signal called 'Release signal', which signal is transmitted from the MT controller to the LT controller, when one or more of the MT compressors are in operation or are ready to start operation, i.e., are ready to start running.

Figure 2:
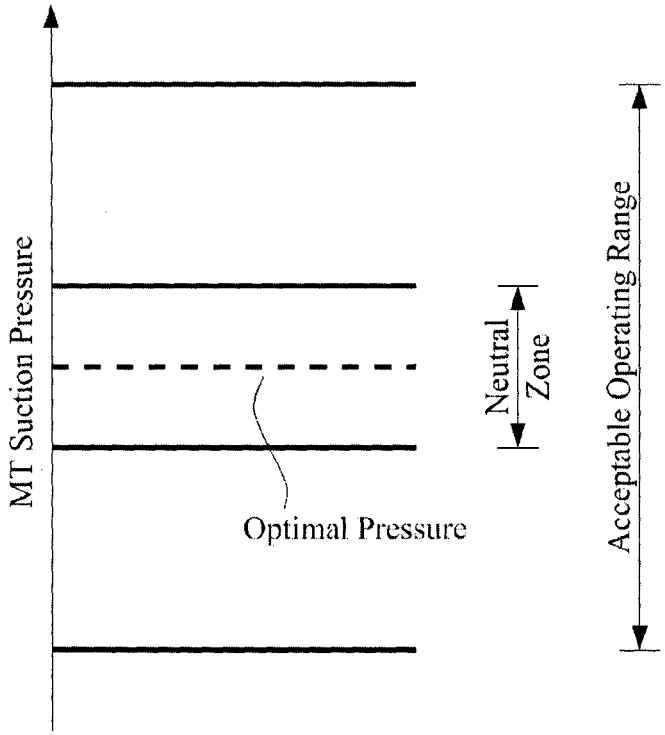
FIG. 2 is a chart showing the function of the LT controller and the MT controller.

FIG. 2 is a chart showing the function of the LT controller and the MT controller.

Various suction pressure levels of the MT part of the compressor circuit are shown as horizontal lines. The middle horizontal line is an optimal operation suction pressure. Above and below the middle line, a neutral zone N is present, and within which the MT compressors operate normally.

The neutral pressure zone is arranged within an acceptable suction pressure zone. The MT compressors are not allowed to operate outside the acceptable operating suction pressure zone, since this may result in safety limits or rated operating ranges for one or more components of the MT part of the cooling circuit being exceeded, and it may therefore lead to damage to one or more components. Thus, the MT compressors are operated in such a manner that the suction pressure in the MT part of the cooling circuit is within the neutral pressure zone, at least for the most of the time. The suction pressure is allowed to exceed the limits of the neutral pressure zone, but not the limits of the acceptable pressure zone.

When it is desired to start operation of one or more LT compressors, and it has been established that none of the MT compressors is running, the actual suction pressure in the MT part of the cooling circuit is compared to the pressure levels shown in FIG. 2. If it turns out that the suction pressure of the MT part of the cooling circuit is within the neutral zone, the LT compressor(s) is/are allowed to start operation, and operation of one or more MT compressors is/are started simultaneously.

If the suction pressure of the MT part of the cooling circuit is above the upper limit of the neutral pressure zone, there is a risk that starting operation of one or more LT compressors will cause an increase in the suction pressure which will drive the suction pressure above the upper limit of the acceptable pressure zone. Therefore, in this case, operation of one or more MT compressors is started, but the LT compressors are not allowed to start. This will cause the suction pressure in the MT part of the cooling circuit to decrease, thereby approaching the neutral pressure zone.

Once the neutral pressure zone is reached, one or more LT compressors is/are allowed to start operation.

If the suction pressure of the MT part of the cooling circuit is below the lower limit of the neutral pressure zone, there is a risk that starting operation of one or more MT compressors will cause a decrease of the suction pressure which will drive the suction pressure below the lower limit of the acceptable pressure zone. Therefore, in this case, operation of one or more LT compressors is started, but the MT compressors are not allowed to start. This will cause the suction pressure in the MT part of the cooling circuit to increase, thereby approaching the neutral pressure zone. Once the neutral pressure zone is reached, one or more MT compressors may be allowed to start operation.

According to the invention, the LT compressors are only allowed to start, when the LT controller receives a release signal transmitted from the MT controller. The release signal is transmitted only when the MT compressors are in ready state, said ready state of the MT compressors being one of the following conditions:

a) the suction pressure in the MT part of the cooling circuit being within a neutral zone, and one or more of the MT compressors are ready to start operation,
b) the suction pressure in the MT part of the cooling circuit initially being below a neutral zone, and one or more of the MT compressors are ready to start operation,
c) the suction pressure in the MT part of the cooling circuit initially being above a neutral zone, and one or more of the MT compressors are put into operation, and until the suction pressure in the MT part of the cooling circuit subsequently has decreased from above the neutral zone to an upper limit of the neutral zone.

Figure 3:
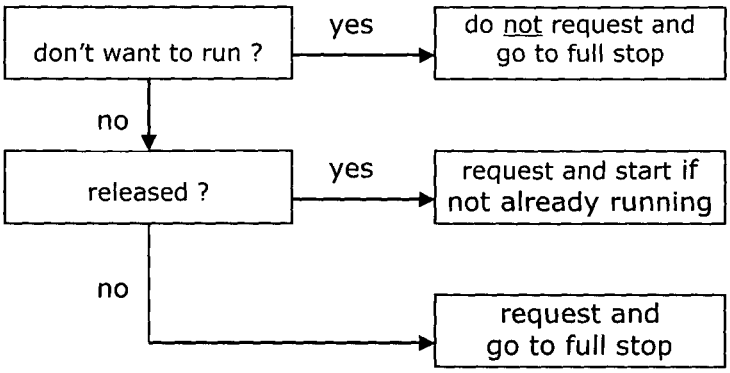
FIG. 3 is a flowchart illustrating a decision tree for the LT controller.

FIG. 3 is a flowchart illustrating a decision tree for the LT controller.

The LT controller decides whether or not it wants the LT compressors to operate. If it decides that this is not the case, it will not transmit a request signal to the MT controller, and it will either refrain from starting the LT compressors or stop any LT compressors which may be operating.

If the LT controller decides that it wants one or more LT compressors to operate, it investigates whether or not the LT compressors are released, i.e. whether or not the MT controller has indicated that it is safe to operate one or more LT compressors. If this is the case, operation of one or more LT compressors is/are started, and/or any LT compressor which is already operating is allowed to continue operation.

If the LT controller establishes that the LT compressors are not released, a request signal is transmitted to the MT controller, and a release signal from the MT controller is awaited. Furthermore, any LT compressors which are operating are stopped.

Figure 4:
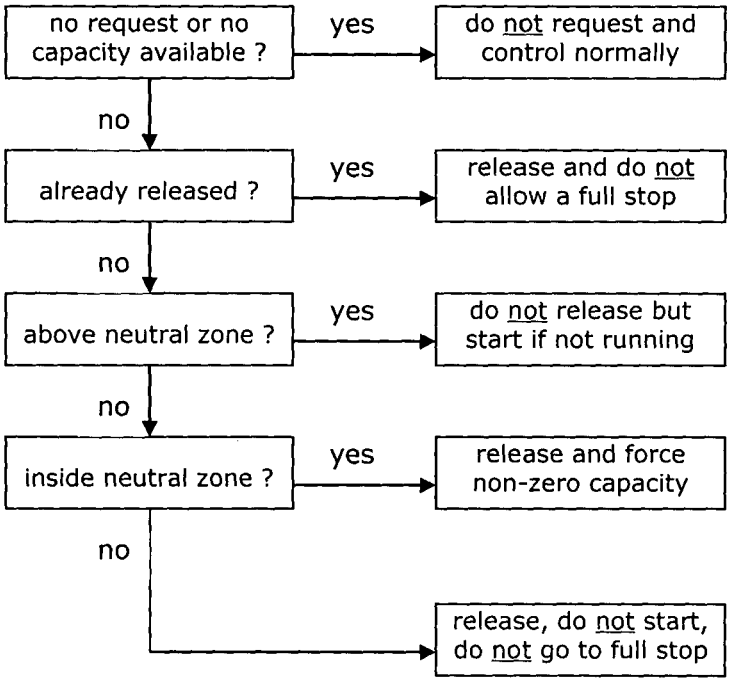
FIG. 4 is a flowchart illustrating a decision tree for the MT controller.

FIG. 4 is a flowchart illustrating a decision tree for the MT controller.

The MT controller checks whether or not a request signal has been received from the LT controller. If this is not the case, no release signal is generated, and the MT compressors are controlled in a normal manner.

If a request signal has been received, the MT controller investigates whether or not a release signal has already been transmitted to the LT controller. If this is the case, another release signal is transmitted to the LT controller, or a previous 'release flag' is simply maintained, and the MT controller ensures that the MT compressors continue operation, i.e. a full stop of all the MT compressors is not allowed.

If the LT compressors are not already released, the suction pressure in the MT part of the cooling circuit is compared to the upper and lower limits of the neutral pressure zone, in the manner described above. If the suction pressure is above the neutral pressure zone, no release signal is generated, but operation of one or more MT compressors is/are started, if no MT compressors are already running.

If the suction pressure is within the neutral pressure zone, a release signal is transmitted to the LT controller, and it is ensured that one or more MT compressors is/are also running. Thus, if one or more MT compressors is/are already operating, it/they is/are kept running, and if no MT compressors are already running, one or more MT compressors is/are started.

If the suction pressure is below the neutral pressure zone, a release signal is transmitted to the LT controller, and the MT compressors are prevented from starting operation.

Special Occasions of Coordination:

On certain conditions of compressor cascade plants, the LT compressors must be allowed to start before start of the MT compressors. It is often not possible ensuring that the MT compressors are ready for starting, when the MT controller receives the 'Request signal' from the LT controller. The LT compressors must not be allowed to be in operation, if the MT compressors are inhibited of starting. In this case, no release signal will be issued by the MT controller.

An injection signal output port of the LT controller may be connected to the input signal port for the signal called 'Request signal' transmitted from the LT controller to the MT controller. When the 'Release signal' is sent from the MT controller to the LT controller, the injection signal will be activated. This causes liquid refrigerant to be injected into the MT part of the cascade heat exchanger. Thereby it is ensured that liquid refrigerant is available for evaporation due to heat exchange with refrigerant flowing in the LT part of the cascade heat exchanger. Accordingly it is ensured that the LT part of the cascade heat exchanger can reject heat via the cascade heat exchanger. It is also ensured that this heat exchange results in gaseous refrigerant being produced in the MT part of the cascade heat exchanger, and thereby an increase in the suction pressure in the MT part of the cooling circuit, eventually resulting in one or more of the MT compressors being started.

Although various embodiments of the present invention have been described and shown, the invention is not restricted thereto, but may also be embodied in other ways within the scope of the subject-matter defined in the following claims.

What is claimed is:

1. A method for coordinating operation between at least two groups of compressors in a cooling circuit, a first group of compressors forming part of a low temperature (LT) part of the cooling circuit and a second group of compressors forming part of a high temperature (MT) part of the cooling circuit, each of the compressor groups comprising one or more compressors, and each of the compressor groups comprising a controller, the controllers being configured to exchange signals, the method comprising the following steps:

investigating whether or not one or more of the MT compressors is/are operating, in the case that one or more of the MT compressors is operating, allowing one or more of the LT compressors to start operation, in the case that none of the MT compressors is operating: establishing the suction pressure in the MT part of the cooling circuit, and comparing the suction pressure to a lower and an upper limit of a neutral pressure zone, said neutral pressure zone lying within an operating pressure zone of the MT part of the cooling circuit, and operating the MT compressors and the LT compressors based on the comparing step;

wherein the step of operating the MT compressors and the LT compressors comprises the step of in the case that the suction pressure in the MT part of the cooling circuit is below the lower limit of the neutral pressure zone, starting at least one of the LT compressors, while preventing the MT compressors from starting.

2. The method according to claim 1, wherein the step of operating the MT compressors and the LT compressors further comprises the steps of:

monitoring the suction pressure in the MT part of the cooling circuit, and when the suction pressure of the MT part of the cooling circuit reaches the neutral pressure zone, starting at least one of the MT compressors in the case that at least one of the LT compressors was/were previously started, or starting at least one of the LT compressors in the case that at least one of the MT compressors was/were previously started.

3. The method according to claim 1, wherein the step of investigating whether or not one or more of the MT compressors is/are operating comprises the steps of the LT controller transmitting a request signal to the MT controller, and the MT controller generating and transmitting a response signal to the LT controller.

4. The method according to claim 1, wherein the cooling system is a cascade cooling system, and wherein the method further comprises the step of injecting refrigerant into the MT side of the cascade heat exchanger of the cooling circuit in the case that the operating step results in one or more LT compressors being started.

5. The method according to claim 1, wherein the cooling system is a booster cooling system.

6. A control unit for coordinating operation between at least two groups of compressors in a cooling circuit, a first group of compressors forming part of a low temperature (LT) part of the cooling circuit and a second group of compressors forming part of a high temperature (MT) part of the cooling circuit, each of the compressor groups comprising one or more compressors, the control unit comprising:

an LT controller arranged for controlling operation of the LT compressor group, and an MT controller arranged for controlling operation of the MT compressor group, said LT controller and said MT controller being configured to exchange signals in order to coordinate operation of the compressor groups according to the method of claim 1.

7. A plant comprising a cooling circuit with at least two groups of compressors, a first group of compressors forming part of a low temperature (LT) part of the cooling circuit and a second group of compressors forming part of a high temperature (MT) part of the cooling circuit, each of the compressor groups comprising one or more compressors, and each of the compressor groups comprising a controller, the controllers being configured to exchange signals in order to coordinate operation of the compressor groups according to claim 1.

8. The plant according to claim 7, wherein the LT controller and the MT controller are embedded in a single common hardware unit, and wherein the LT controller and the MT controller are individual software applications embedded in the single common hardware unit.

9. The method according to claim 2, wherein the step of investigating whether or not one or more of the MT compressors is/are operating comprises the steps of the LT controller transmitting a request signal to the MT controller, and the MT controller generating and transmitting a response signal to the LT controller.

10. The method according to claim 2, wherein the cooling system is a cascade cooling system, and wherein the method further comprises the step of injecting refrigerant into the MT side of the cascade heat exchanger of the cooling circuit in the case that the operating step results in one or more LT compressors being started.

11. The method according to claim 3, wherein the cooling system is a cascade cooling system, and wherein the method further comprises the step of injecting refrigerant into the MT side of the cascade heat exchanger of the cooling circuit in the case that the operating step results in one or more LT compressors being started.

12. The method according to claim 2, wherein the cooling system is a booster cooling system.

13. The method according to claim 3, wherein the cooling system is a booster cooling system.

14. A control unit for coordinating operation between at least two groups of compressors in a cooling circuit, a first group of compressors forming part of a low temperature (LT) part of the cooling circuit and a second group of compressors forming part of a high temperature (MT) part of the cooling circuit, each of the compressor groups comprising one or more compressors, the control unit comprising:

an LT controller arranged for controlling operation of the LT compressor group, and an MT controller arranged for controlling operation of the MT compressor group, said LT controller and said MT controller being configured to exchange signals in order to coordinate operation of the compressor groups according to the method of claim 1.

15. A control unit for coordinating operation between at least two groups of compressors in a cooling circuit, a first group of compressors forming part of a low temperature (LT) part of the cooling circuit and a second group of compressors forming part of a high temperature (MT) part of the cooling circuit, each of the compressor groups comprising one or more compressors, the control unit comprising:

an LT controller arranged for controlling operation of the LT compressor group, and an MT controller arranged for controlling operation of the MT compressor group, said LT controller and said MT controller being configured to exchange signals in order to coordinate operation of the compressor groups according to the method of claim 2.

16. A control unit for coordinating operation between at least two groups of compressors in a cooling circuit, a first group of compressors forming part of a low temperature (LT) part of the cooling circuit and a second group of compressors forming part of a high temperature (MT) part of the cooling circuit, each of the compressor groups comprising one or more compressors, the control unit comprising:

an LT controller arranged for controlling operation of the LT compressor group, and an MT controller arranged for controlling operation of the MT compressor group, said LT controller and said MT controller being configured to exchange signals in order to coordinate operation of the compressor groups according to the method of claim 3.

17. The method according to claim 1, wherein the step of operating the MT compressors and the LT compressors further comprises the step of in the case that the suction pressure in the MT part of the cooling circuit is within the neutral pressure zone, starting at least one MT compressor and at least one LT compressor substantially simultaneously.

18. The method according to claim 1, wherein the step of operating the MT compressors and the LT compressors further comprises the step of in the case that the suction pressure in the MT part of the cooling circuit is above the upper limit of the neutral pressure zone, starting at least one of the MT compressors, while preventing the LT compressors from starting.

* * * * *